United States Patent [19]

Kimura et al.

[11] 4,249,680

[45] Feb. 10, 1981

[54] SECTOR SLIDING PLATE BRICK HAVING DISCHARGE PORTS AND AN IMPROVED SLIDING NOZZLE APPARATUS

[75] Inventors: Morihiro Kimura, Tokyo; Kenji Yamamoto, Bizen; Masahiko Nose, Waki, all of Japan

[73] Assignee: Shinagawa Refractories Co., Ltd., Tokyo, Japan

[21] Appl. No.: 959,168

[22] Filed: Nov. 9, 1978

[30] Foreign Application Priority Data

Nov. 28, 1977 [JP] Japan ..... 52-141681

[51] Int. Cl.[3] ..... B22D 41/08

[52] U.S. Cl. ..... 222/598; 222/600; 222/545

[58] Field of Search ..... 222/598, 600, 555, 557, 222/560, 561, 545

[56] References Cited

U.S. PATENT DOCUMENTS 3,743,007 7/1973 Simons et al. ..... 222/600 X 3,780,916 12/1973 Shapland ..... 222/555

FOREIGN PATENT DOCUMENTS 1281643 10/1968 Fed. Rep. of Germany ..... 222/598

OTHER PUBLICATIONS

Tanaka, "Nippon Kolan's Rotary Nozzle System . . . " *Iron and Steel Engineer;* Sep. 1973, pp. 117–124.

*Primary Examiner*—David A. Scherbel

*Attorney, Agent, or Firm*—Larson, Taylor and Hinds

[57] ABSTRACT

A sector sliding plate brick having a plurality of discharge ports for use in a sliding nozzle apparatus for casting molten metal, characterized in that the plane configuration of said sliding plate brick forms a sector shape or a shape similar to sector, each center of the discharge ports of more than two pierced on said sector plane exists at point corresponding to a definite distance from the common center of an arc passing through the center of each discharge port, and the sliding plate brick can revolve on said common center as fulcrum.

4 Claims, 5 Drawing Figures

SECTOR SLIDING PLATE BRICK HAVING DISCHARGE PORTS AND AN IMPROVED SLIDING NOZZLE APPARATUS

This invention relates to an improved sliding plate brick shape and an improved sliding nozzle apparatus for said brick, which are used in an apparatus for carrying out opening and closing actions by means of multi-directional sliding to control the flow, in a sliding nozzle for use in casting molten metal.

According to conventional sliding nozzle, a fixed plate is supported by a metal frame and connected to an outer shell steel plate of molten metal vessel, said fixed plate is combined with a sliding plate having a single opening, which is brought into close contact with the fixed plate and slides straight forward and backward, maintaining a surface pressure, and said sliding plate is slid straight forward and backward so as to pen and close the sliding nozzle.

Studies have been made to prolong the endurable life of plate bricks as long as possible, but each plate brick is heavily damaged during its use and its life is extremely shortened compared with that of metal frame. Because of this, plate brick is fixed with disengagable construction and it is replaced with new one when its life has expired. Thus the replacing of plate bricks is a very important working.

However, the following are the disadvantages for the sliding plate brick of the sliding nozzle apparatus and for the pouring operation, said sliding nozzle apparatus being constructed in such a way that the sliding plate bricks are provided with a single discharge port, and the sliding nozzle apparatus is opened and closed by means of straight forward and backward sliding.

(a) Plate bricks must be replaced frequently, and the work of replacing the bricks requires a lot of labor and time.

(b) Plate bricks are replaced in a state in which both the bricks and the apparatus are burned hot with on-line system so that the working conditions are bad and require hard labor.

(c) Because of roughening of the surface of plate brick and enlarging of the port diameter, bad stopping of the melt is sometimes brought about even if the sliding nozzle apparatus is closed with complete sliding stroke, thereby involving a danger.

Thus the conventional sliding plate brick has fatal weak points owing to its rectilinear sliding with a single discharge port, and it is inconvenient and uneconomical since it requires expertness on the labor scene and expensive vicarious compensation. Under the present circumstances, however, the conventional sliding plate is used even with full realization of the inconvenience and un-economy.

In order that the invention may be more clearly understood some embodiments thereof will be described, by way of example, with reference to the accompanying drawings, in which:

FIG. 3 being a vertical section taken along the line A—A of FIG. 2;

The present invention is to provide a novel configuration of sliding plate brick used for sliding nozzle apparatus which controls the flow by multi-directional sliding, and an apparatus most suitable for using said brick.

Figure 1:
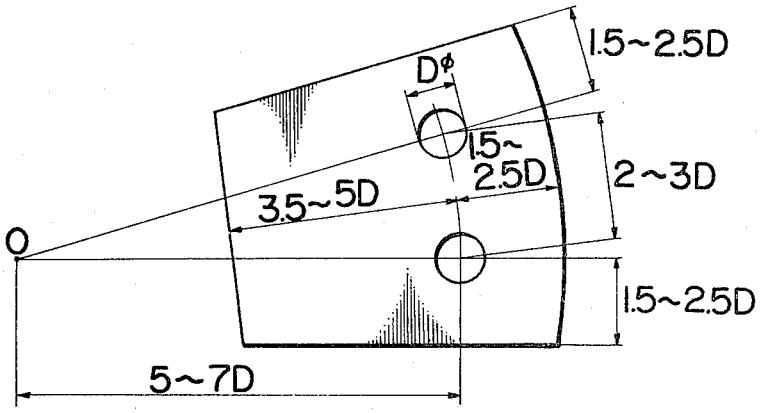
FIG. 1 is a plan view showing an embodiment of a sector sliding plate brick having a plurality of ports according to the invention, in which the unit being in millimeter.

According to the invention, a plurality (more than two) of discharge ports are arranged on an arc on a point O (hereinafter called common center) as shown in FIG. 1.

For example, an arrangement of the discharge ports within a certain regular range as shown in the drawing will be practically useful.

Generally, an arrangement of the discharge ports is determined in such a way that each center of the discharge ports of more than two, which are bored on a plane of sector shape (including shapes similar to sector), is positioned at a point corresponding to a definite distance from the common center of the arc, which passes through the center of each discharge port.

The present invention is characterized in that if one of discharge ports and a sliding surface in plate brick become useless due to damage or roughening, the sliding plate brick is rotationally slid on the common center O to change the discharge ports one after another, the discharge ports are opened and closed by sliding said plate brick straight forward and backward as in the past, and thus a single sheet of sliding plate brick can be continuously used many times without replacement thereof.

The invention achieves effects of settling or relieving all the demerits (a) to (c) above caused by conventional sliding plate brick having only a single discharge port.

Particularly, the chances of replacing the sliding plate bricks decrease in inverse proportion to the number of discharge ports, compared with conventional plate brick having a single port, so that replacement working is relieved and reduced, replacing period is delayed, the time loss by the replacement working can be shortened minimum, and therefore it is possible to improve the operation efficiency for steel making.

Further, by switching a discharge port over another it is possible to eliminate the danger of bad melt stoppage caused by the surface roughening and enlarged port diameter of the plate brick.

Furthermore, it is possible to make efficient use of a plate brick by employing the sector plate brick relating to the present invention.

By comparison, the weight of the brick required for a port in the invention will be decreased to 60–80% of the conventional type brick.

The following will be the disadvantages in case a number of ports are bored to a disc plate known as multi-directional sliding plate brick, and the ports are opened and closed by rotational sliding and straight forward and backward sliding.

(d) In the case of employing disc plate, the brick and the apparatus become larger than the rotary nozzle presently in use thereby requiring a lot of labor and time for the replacement working of brick.

(e) The use of disc plate makes the apparatus intricate, and there must be provided such a mechanism that a slide casing capable of replacing brick with on-line system is mounted to a housing through a hinge or toggle mechanism, and sliding plate brick can be replaced quickly. However, utilization of such a quick-type mechanism is hard.

Figure 5:
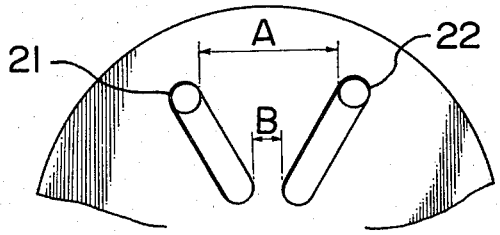
FIG. 5 is a schematic plan view showing an arrangement of discharge ports of conventional round sliding plate brick of multi-directional sliding rotary type.

(f) As shown in FIG. 5, in a disc plate the space A between discharge ports 21 and 22 must retain a definite distance, provided against enlarging port diameter, craking, etc., and it is necessary also for the space B to maintain a regular distance, provided against the roughening of the plate surface, etc. In the case of employing said disc plate, however, the space B may be reduced to lower safety if said space A is based on, and to the contrary the space A may be unnecessarily enlarged to enlarge the brick size unnecessarily if the basis is placed upon said space B. Accordingly the brick cannot be effectively used thereby necessitating both larger brick and apparatus.

In view of the above disadvantages the sliding plate of the invention is devised in such a way that the revolutionary (rotational) center is taken at the common center O (FIG. 1) outward from the brick so as to establish said spaces A and B simultaneously minimu, and that unnecessary portion of the brick can be removed but the brick can be effectively used.

Accordingly, by using the sector sliding plate (brick) relating to the invention or the similar-to-sector one which may have substantially the same function and effect along the purport of the invention, it is possible to make both the sliding plate brick and sliding nozzle apparatus minimum-sized and compact whereby exerting effect of remarkably improving the work when replacing said bricks.

Figure 2:
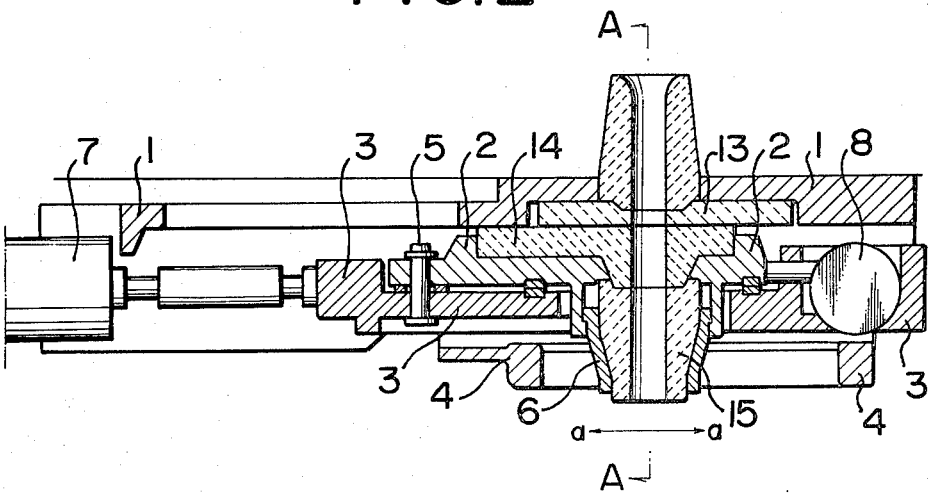
FIGS. 2 and 3 are vertical sectional views showing one embodiment of a sliding nozzle apparatus for using the sector sliding plate brick having a plurality of ports in the invention.
Figure 3:
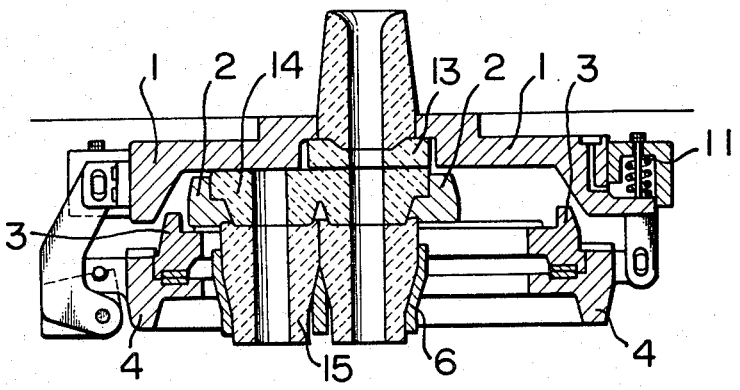
Figure 4:
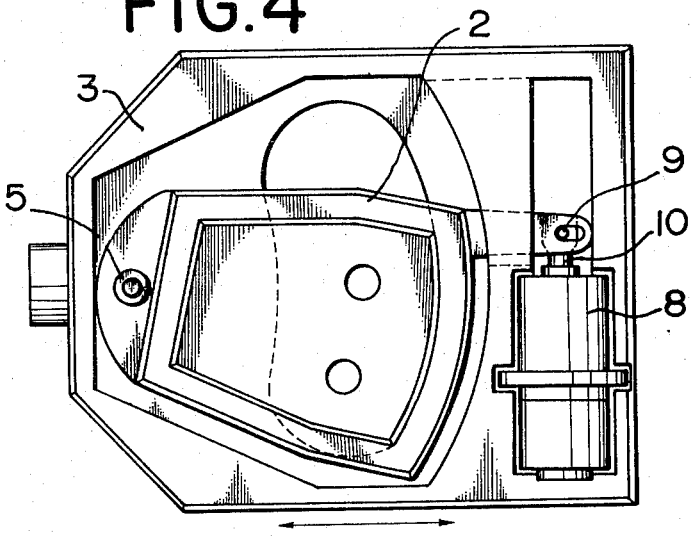
FIG. 4 is a plan view showing the principal portion of said sliding nozzle apparatus and exemplifying a state in which the sector sliding plate brick having a plurality of ports is set according to the invention.

Moreover, as shown in FIGS. 2 to 4, the invention has another feature in that the apparatus can be made a quick-type system using a toggle mechanism under simplified construction by employing the sliding plate of a sector shape (including shapes similar to sector) according to the invention, and that the brick can be easily replaced with on-line system.

The invention will now be further described with reference to the accompanying drawings.

FIG. 1 shows a sector sliding plate brick in which discharge ports of more than two are bored at a regular arrangement on an arc (a portion of circumference) on the common center O.

FIG. 1 shows, as an example, a sliding plate brick having two discharge ports. In a concrete embodiment based on practical use it is particularly effective to determine each dimension on the standard of port diameter as shown in FIG. 1, irrespective of the number of discharge port. The dimension can be determined by making the port diameter D mm and the common center O center, and arranging the discharge ports at 2–3 D mm intervals on an arc having a 5–7 D mm radius. Other dimentions can also be determined on the standard of the port diameters D as shown in FIG. 1. A sector sliding plate brick 14 relating to the invention is brought into contact with the lower surface of a bottom plate brick 13, it is turned and slid on an arc on the common center O, and it is used by changing the discharge ports one after another, so that brick must be set to an apparatus matched therewith.

One embodiment of such an apparatus is shown in FIGS. 2 to 4.

The sliding nozzle apparatus of the present invention is constructed in such a manner that the apparatus can be slid in the lengthy directions (a—a) by a rectilinear oil pressure cylinder 7 which is disengagably mounted to a housing 1, that to provide an upward support force enough to generate a required surface pressure, the apparatus is revolvably mounted around a pin 5 for revolution of the sliding plate through said pin 5, to a support frame 3 upwardly supported by a clamp 4, and that a sliding casing 2 is provided around said pin 5 for revolution of the sliding plate, said sliding casing being capable of turning by an oil pressure cylinder 8 for revolution mounted to the support frame 3. Said cylinder 8 is disengagably mounted to the support frame 3, and a rod end 10 of said cylinder 8 is connected to a slide casing 2 through a pin 9 provided to said rod end 10.

In the present invention, the mounting position of the rectilinear oil pressure cylinder 7, and the surface pressure load system of toggle type which uses a compressed coil spring 11 as shown in FIG. 3, are not limited to the described embodiments, and various known methods can be applied. Further, it is optionally chosen whether with regard to change nozzle bricks 15, bricks similar to conventional ones are mounted one by one to a continuous casing 6 or bricks in integrity having a plurality of discharge ports are used.

Although the sliding plate brick and the apparatus according to the invention are thus of multi-directional sliding system, they are of the remarkably simplified construction compared with conventional ones, it is possible to arrange them in very compact and small-sized order, the replacement working of the sliding plate bricks is simplified and improved, and it results in a long life use of sliding plate brick and an economization of refractory material, thereby contributing to distinguished rationalization for steel-making work.

What is claimed is:

1. A sliding nozzle apparatus for casting molten metal comprising a sector-shaped sliding plate comprising a refractory material and having a plurality of discharge ports therethrough, the plane configuration of said plate having a sector-like shape, the center of each discharge port in said sector plate being located at a point corresponding to a definite distance from the common center of an arc passing through the center of each discharge port, means for rotating said plate about said common center, and means for moving said plate lengthwise for movement of a discharge port towards and away from said common center.

2. Sliding nozzle apparatus according to claim 1 wherein said sliding plate is mounted in a sliding casing, said sliding casing being rotatably mounted in a support frame for rotation about a pin, said pin being located at said common center.

3. Sliding nozzle apparatus according to claim 2 wherein said plate rotating means comprises hydraulic piston means for moving said sliding casing rotatably about said pin.

4. Sliding nozzle apparatus according to claim 3 wherein said lengthwise moving means comprises hydraulic piston means for moving said support frame.

* * * * *